United States Patent [19]

Kitamura et al.

[11] 4,236,914

[45] Dec. 2, 1980

[54] DESULFURIZATION COMPOSITION FOR MOLTEN PIG IRON

[76] Inventors: Minoru Kitamura, 20-25 Kitaguchi-cho, Nishinomiya-shi, Hyogo-ken; Tsutomu Hayashi, 1217-95 Kitano, Noguchi-cho; Takeharu Moritsugi, 1261-31 Kitano, Noguchi-cho, both of Kakogawa-shi, Hyogo-ken; Mitsuyoshi Saruwatari, No. 993, 0aza-Ichino, Oomuta-shi, Fukuoka-ken, all of Japan

[21] Appl. No.: 66,697

[22] Filed: Aug. 15, 1979

[51] Int. Cl.[3] ..... C21C 7/02

[52] U.S. Cl. ..... 75/58; 75/53

[58] Field of Search ..... 75/53, 58

[56] References Cited

U.S. PATENT DOCUMENTS

| | | | |
|---|---|---|---|
| 3,622,302 | 11/1971 | Hayashi | 75/58 |
| 3,656,989 | 4/1972 | Loyland | 75/58 |
| 3,769,004 | 10/1973 | Barnhardt | 75/58 |
| 4,169,724 | 10/1979 | Freissmuth | 75/58 |

FOREIGN PATENT DOCUMENTS

| | | | |
|---|---|---|---|
| 721717 | 1/1955 | United Kingdom | 75/130 R |

OTHER PUBLICATIONS

Trentini, *Journal of the Iron and Steel Institute,* vol. 183, pp. 124–133, (Jun. 1956).

*Primary Examiner*—P. D. Rosenberg

[57] ABSTRACT

A desulfurizing composition which is fed together with nitrogen into a molten pig iron in a desulfurization. The desulfurizing composition comprises 0.3 to 10 wt.% of a carbon source for preventing secondary coagulation and 1 to 10 wt.% of a magnesium compound for inhibiting of calcium cyanamide and the main component of calcium carbide for the desulfurization.

5 Claims, No Drawings

DESULFURIZATION COMPOSITION FOR MOLTEN PIG IRON

BACKGROUND OF THE INVENTION

The present invention relates to a desufurizing composition for molten pig iron. More particularly, it relates to a desulfurizing composition which is suitable for a blow desulfurization in which the desulfurizing composition and a carrier gas are fed into the molten pig iron from a lance nozzle.

The known desulfurizing agents used for the blow desulfurization are, for example, calcium carbides ($CaC_2$) and calcium carbonates ($CaCO_3$). Among them, calcium carbide has been considered to be the optimum because of the following reasons.

The desulfurization using calcium carbide ($CaC_2$) is shown by the following reaction formula:

$$CaC_2+S \rightarrow CaS+2C$$

$$CaC_2+FeS \rightarrow CaS+2C+Fe$$

① The effect of the desulfurization is remarkable because the desulfurization is the direct reduction of sulfur (S) in the molten pig iron by calcium carbide ($CaC_2$).

② The resulting calcium sulfide (CaS) is chemically stable and is not converted into sulfur (S) in the molten pig iron.

③ The reaction is the exothermic reaction and accordingly, the lowering of the temperature in the desulfurization is small.

The other advantageous characteristic of the desulfurization is that calcium carbide ($CaC_2$) is easily oxidized at high temperature. When oxygen is included in the molten pig iron, calcium carbide ($CaC_2$) is oxidized to form calcium oxide (CaO) before reducing sulfur whereby the desulfurization function is remarkably decreased. Therefore, it is preferable to use an inert gas such as nitrogen gas as a carrier gas because of stable desulfurization function.

In the desulfurization, the lance nozzle is dipped into the molten pig iron at about 1300°-1400° C. in a depth of about 1 to 2 m. from the surface of the molten iron and the powdery calcium carbide ($CaC_2$) is fed with the carrier gas of nitrogen etc. into the molten pig iron.

It has been reported that a viscous material is easily adhered on the lance nozzle to clog the lance nozzle or to decrease the area of the opening during the operation. Thus, the shortage or stop of the feeding of the desulfurizing agent is caused and the desulfurization function is remarkably decreased or the desulfurization can not be continued. The adhered material is not easily removed. Thus, the lance nozzle should be often exchanged. This is remarkably uneconomical.

The inventors have studied to overcome these troubles of the clogging of the lance nozzle especially the reason of the trouble in view of said facts. As a result, the fact that calcium cyanamide ($CaCN_2$) having high molten viscosity is formed by the following reaction of calcium carbide ($CaC_2$) with nitrogen in the blowing condition and the resulting calcium cyanamide deposits and adheres on the lance nozzle.

$$CaC_2+N_2 \rightarrow CaCN_2+C$$

The reaction is caused at a relatively low temperature of about 900° C. The production of calcium cyanamide is remarkably increased depending upon the elevation of the temperature. The reaction for producing calcium cyanamide at the desulfurization temperature of about 1300° to 1400° C. is performed at remarkably high velocity.

Thus, it is considered to reduce the reaction for producing calcium cyanamide or to prevent the adhesion of calcium cyanamide on the nozzle even though calcium cyanamide ($CaCN_2$) is produced, in order to prevent the trouble of the clogging of the nozzle.

The inventors have further studied to develop means for preventing the clogging of the nozzle.

SUMMARY OF THE INVENTION

It is an object of the present invention to prevent a trouble of the clogging of the nozzle caused by the deposition and adhesion of calcium cyanamide in the blow desulfurization.

It is another object of the present invention to provide a desulfurizing agent for molten pig iron which does not cause the clogging of the nozzle in the molten pig iron.

The foregoing and other objects of the present invention have been attained by providing a desulfurizing composition for molten pig iron which comprises 0.3 to 10 wt. % of a carbon source, 1 to 10 wt. % of a magnesium compound as MgO and calcium carbide as a residual component.

DETAILED DESCRIPTION OF THE PREFERRED EMBODIMENTS

The trouble of the clogging of the nozzle has been prevented by using the desulfurizing composition prepared by incorporating the carbon source and the magnesium compound into calcium carbide at suitable ratios because the deposition and adhesion of calcium cyanamide on the nozzle can be remarkably prevented.

The desulfurizing composition for molten pig iron of the present invention is a powder which comprises calcium carbide as the main component and 0.3 to 1.0 wt. % of the carbon source and 1 to 10 wt. % of the magnesium compound as MgO.

The feature of the present invention is to incorporate the magnesium compound and the carbon source into calcium carbide as the main component at suitable ratios. These components impart the following functions.

The magnesium compound especially magnesium oxide (MgO) reacts with iron oxide (FeO) in the molten pig iron (it is usual to contain about 0.1 wt. %) to produce a FeO-MgO type compound having high softening point. The resulting FeO-MgO type compound prevents the deposition and adhesion of calcium cyanamide ($CaCN_2$) having high molten viscosity on the nozzle.

The carbon source is useful for preventing the trouble caused by incorporating the magnesium compound such as MgO. The clogging of the nozzle can be prevented by incorporating the magnesium compound such as MgO. However, a secondary agglomeration is easily caused at the time just after feeding the magnesium compound such as MgO into the molten pig iron. As a result, the shortage of the production of the FeO-MgO type compound is caused whereby the effect for preventing the deposition and adhesion of calcium cyanamide on the nozzle is disadvantageously decreased. However, when the carbon source is incorporated together with the magnesium compound such as MgO, the secondary coagulation of the magnesium compound such as MgO in the molten pig iron is remarkably inhibited whereby the effect for the addition of the magnesium compound such as MgO is effectively imparted.

Suitable contents of the magnesium compound and the carbon source for imparting the above-mentioned effect are respectively in a range of 1 to 10 wt. % as MgO and in a range of 0.3 to 10 wt. % as carbon.

When the content of the magnesium compound is less than 1 wt. % (as MgO), the production of the FeO-MgO type compound having high melting point which is produced by the reaction with iron oxide (FeO) in the molten pig iron is too small and the adhesion of calcium cyanamide on the nozzle can not be disadvantageously prevented. On the other hand, when the content of the magnesium compound is more than 10 wt. % (as MgO), the effect for preventing the adhesion on the nozzle is not substantially improved whereas the content of calcium carbide is relatively decreased and only the desulfurization function is decreased. Therefore, it is not preferable to incorporate more than 10 wt. %.

When the content of carbon is less than 0.3 wt. %, the secondary coagulation of the magnesium compound can not be prevented and the effect for preventing the adhesion of calcium cyanamide on the nozzle can not be disadvantageously imparted. On the other hand, when the content of carbon is more than 10 wt. %, the effect is not substantially improved whereas the content of calcium carbide is relatively decreased and only the desulfurization function is decreased.

Thus, when the magnesium compound and carbon are incorporated at the above-mentioned desired ranges, the FeO-MgO type compound is always produced at suitable ratio during the desulfurization and excellent desulfurization is performed while preventing the deposition and adhesion of calcium cyanamide on the nozzle.

Calcium carbide as the main component can be a commercially available product which generates acetylene at a rate of about 300 liter/kg. and calcium carbide is preferably used after pulverizing it to have particle diameters of less than 500μ. because when calcium carbide having large diameters is used, calcium carbide is not smoothly fed into the molten pig iron and the desulfurization velocity is decreased depending upon the decrease of the surface area.

Graphite, coke, anthracite, charcoal or carbon black is used as the carbon source. In order to prevent a trouble caused by the impurity, it is preferable to use the carbon source having high purity of greater than 80%. It is especially preferable to use the carbon source which does not contain a component for foming water. If water is formed in the step of feeding the desulfurizing composition, calcium carbide ($CaC_2$) as the main component of the desulfurizing agent reacts with water to decrease the desulfurization function by the following reaction.

$$CaC_2 + 2H_2O \rightarrow Ca(OH)_2 + C_2H_2$$

In view of the smooth feeding and the improvement of the effect, the particle diameter of the carbon source is preferably smaller and especially less than 44μ.

Suitable magnesium compounds include magnesia clinker, dolomite clinker, magnesium chloride etc. Among them, magnesia clinker is preferably used as it has higher content of MgO and does not form a toxic gas.

As it is the same reason as those of calcium carbide and the carbon source, the particle diameter of the magnesium compound is preferably smaller and especially less than 44μ.

As it is the same reason as that of the carbon source, it is preferable to use the magnesium compound which has smaller content of an impurity which forms water.

The present invention is briefly described. The following various effects have been attained by incorporating the carbon source and the magnesium compound at suitable ratios to calcium carbide as the main component of the desulfurization composition.

① When powdery calcium carbide is fed with nitrogen gas into the molten pig iron in the desulfurization, calcium cyanamide is produced to cause the clogging of the lance nozzle. However, when the desulfurizing composition of the present invention is used, the deposition and adhesion of calcium cyanamide on the lance nozzle can be remarkably prevented whereby the clogging of the nozzle can be remarkably decreased.

② As a result, the trouble of the decrease of the rate of the feeding of the desulfurizing composition or the stop of the feeding of the desulfurizing agent can be prevented whereby the desulfurization function is remarkably improved.

③ The clogging of the lance nozzle is not easily caused and the life of the lance nozzle is prolonged to decrease the economical expense. The exchanges of the lance nozzle can be minimized to decrease the labour for the operator.

The present invention will be further illustrated by certain examples and references which are provided for purposes of illustration only and are not intended to be limiting the present invention.

EXAMPLE 1

Powdery calcium carbide having particle diameters of less than 105μ (90 wt. %), magnesia clinker having particle diameters of less than 44μ (a content of MgO component of 98.5%) (8 wt. %) and a petroleum coke having particle diameters of less than 44μ (0.75 wt. %) were pulverized and mixed by a grinder mill to obtain a desulfurizing composition having particle diameters of less than 74μ (no larger particle).

The desulfurizing composition (0.2 wt. %) was fed together with nitrogen gas through a lance nozzle into a molten pig iron at 1300° C. in a cupola so as to carry out the desulfurization.

The result of the desulfurization during 2 months is shown in Table 1. As a reference, the result of the desulfurization by feeding calcium carbide having particle diameters of less than 105μ together with nitrogen gas is also shown in Table 1.

TABLE 1

| Desulfurizing agent | Invention | Reference |
|---|---|---|
| Before desulfurization | 40 | 41 |
| After desulfurization ($S(\%) \times 10^{-3}$ in molten pig iron) | 12 | 16 |
| Percent desulfurization (%)* | 70.0 | 60.9 |
| Times of operations for removing adhered material on lance nozzle | 10–20 | 500–1000 |

TABLE 1-continued

| Desulfurizing agent | Invention | Reference |
|---|---|---|
| (times/month) | | |

Note:

$$\text{*Percent desulfurization} = \frac{\text{(S) in molten pig iron before D} - \text{(S) in molten pig iron after D}}{\text{(S) in molten pig iron before D}} \times 100$$

(D: desulfurization)

As it is clearly understood from the results shown in Table 1, when the desulfurizing composition of the present invention is used, the adhesion on the lance nozzle was remarkably small and the operations for removing the adhered material could be decreased (about 1/50 time to the conventional case).

The percent desulfurization was improved for about 10% by using the desulfurizing composition of the present invention.

In accordance with the present invention, the operations for removing the adhered material from the nozzle can be remarkably decreased, and moreover, high percent desulfurization can be given in comparison with the conventional case. The three important requirements of the prolonged life of the lance nozzle, the improvement of the operations and the increase of the percent desulfurization can be satisfied.

EXAMPLE 2

Powdery calcium carbide having particle diameters of less than 100μ (85 wt. %), dolomite clinker having particle diameters of less than 44μ (12 wt. %), and carbon black having particle diameters of less than 10μ (3 wt. %) were uniformly mixed to obtain a desulfurizing composition.

In accordance with the process of Example 1 except using the resulting desulfurizing composition, at a ratio of 0.3 wt. % to the molten pig iron, the desulfurization was carried out. As a result, the percent desulfurization was 69.0 wt. %. The operations for removing the adhered material on the lance nozzle could be decreased as similar to those of Example 1.

We claim:

1. A desulfurizing composition which is fed into molten iron with a nitrogen containing inert gas and which comprises 0.3 to 10 wt. % of a carbon source selected from the group consisting of graphite, coke, anthracite, charcoal and carbon black; 1 to 10 wt. % of a magnesium compound calculated as MgO; and calcium carbide as a residual component.

2. A desulfurizing composition according to claim 1 wherein the powdery calcium carbide having particle diameters of less than 500μ, the carbon source having particle diameters of less than 44μ and the magnesium compound having particle diameters of less than 44μ.

3. A desulfurizing agent according to claim 1 or 2 wherein the magnesium compound is magnesium clinker.

4. A desulfurizing composition according to claim 1 or 2 wherein the magnesium compound is dolomite clinker.

5. A desulfurizing composition according to claim 1, wherein the carbon source has a purity of greater than 80%.

* * * * *